United States Patent [19]

Hirakawa et al.

[11] Patent Number: 4,684,333

[45] Date of Patent: Aug. 4, 1987

[54] SELF-PRIMING PUMP

[75] Inventors: Norishige Hirakawa, Saitama; Kazuo Okada; Kazuhiko Sato, both of Kawagoe, all of Japan

[73] Assignee: Iwaki Co., Ltd., Tokyo, Japan

[21] Appl. No.: 881,224

[22] Filed: Jul. 2, 1986

[30] Foreign Application Priority Data

Jul. 10, 1985 [JP] Japan ..... 60-151548

[51] Int. Cl.[4] ..... F04B 49/02; F16K 24/00

[52] U.S. Cl. ..... 417/420; 417/199 A; 417/299; 137/216

[58] Field of Search ..... 417/420, 423 S, 424 R, 417/199 A, 200, 299, 307; 415/24, 49; 137/215, 216

[56] References Cited

U.S. PATENT DOCUMENTS

| | | | |
|---|---|---|---|
| 3,465,681 | 9/1969 | Zimmermann | 417/420 |
| 4,047,847 | 9/1977 | Okawa | 417/420 |
| 4,152,099 | 5/1979 | Bingler | 417/420 |
| 4,545,735 | 10/1985 | Ims | 417/566 |

FOREIGN PATENT DOCUMENTS

| | | | |
|---|---|---|---|
| 59-8675 | 2/1984 | Japan . | |
| 2124302 | 2/1984 | United Kingdom | 417/200 |

*Primary Examiner*—Carlton R. Croyle
*Assistant Examiner*—Leonard Walnoha
*Attorney, Agent, or Firm*—Frishauf, Holtz, Goodman & Woodward

[57] ABSTRACT

A communication hole is bored through a partition member which divides an intake-side priming fluid chamber from a discharge-side priming fluid chamber, whereby the two chambers are connected. The communication hole serves to prevent, on a predetermined level, a backflow of a pump fluid due to siphonage caused on the intake side when pumping operation is stopped, thereby securing a priming fluid in a pump casing. A valve assembly including a valve member is disposed corresponding to the communication hole. The valve member, which is always urged to an open position, is moved to and held in a position where it is caused to close the communication hole by the action of the pump fluid flowing in a feeding direction during pumping operation. When the pump is stopped to cause the backflow of the fluid, the valve member is moved back to the open position by the urging action.

12 Claims, 12 Drawing Figures

SELF-PRIMING PUMP

BACKGROUND OF THE INVENTION

The present invention relates to a self-priming pump in which a pump casing is formed with an intake-side priming fluid chamber communicating with an inlet port, a discharge-side priming fluid chamber communicating with an outlet port, and a pump chamber containing an impeller therein.

In self-priming pumps of this type, when the pump drive is stopped, a pump fluid ceases to flow in a feeding direction and is sucked to the intake side by a difference in pressure between the intake and discharge sides, thus causing a backflow. In this case, a priming fluid to be secured in the priming fluid chambers may possibly flow out of the pump casing, urged by the backflow caused by siphonage on the intake side.

In order to avoid this, a communication hole or orifice is bored through a partition member which divides the intake-side priming fluid chamber from the discharge-side priming fluid chamber, the hole corresponding in position to the level of the priming fluid to be maintained. Thus, when the surface level of the fluid lowers to reach the level of the communication hole when the fluid flows backward, the two priming fluid chambers communicate with each other by means of the hole. As a result, the effect of siphonage is canceled to maintain the predetermined priming fluid level. This arrangement is already disclosed in, for example, Japanese Patent Publication No. 59-8675.

Although the communication hole is a small orifice, however, a circulating flow passes through it to cause a leakage of pressure between the intake and discharge sides during pumping operation, since the hole is left open at all times. Consequently, the discharge pressure and discharge rate are reduced to lower the pump efficiency. Also during self-priming operation for the start of the pumping operation, the intake-side negative pressure cannot sufficiently be increased due to the pressure leakage through the communication hole. Thus, the efficiency of the self-priming operation would be lowered.

In an alternative prior art arrangement of the self-priming pump, a non-return valve is provided near an inlet port. During the pumping operation, in this case, the valve opens to allow the fluid to flow in the feeding direction. When the pumping operation is stopped, the valve is closed to prevent the fluid from flowing out through the inlet port if a backflow is caused by siphonage on the intake side. In this manner, the priming fluid is secured in the pump. With this arrangement, however, the position of the inlet port must be aligned with the surface level of the priming fluid to be maintained, lowering the degree of freedom of the layout of the inlet port.

SUMMARY OF THE INVENTION

The object of the present invention is to provide a self-priming pump capable of securing a sufficient priming fluid in a pump casing without lowering the pump efficiency or self-priming efficiency.

In order to achieve the above object, a self-priming pump according to the invention is constructed so that a valve assembly is provided corresponding to communication hole means formed in a partition member dividing an intake-side priming fluid chamber and a discharge-side priming fluid chamber, the valve assembly having a valve member movable between an open position where the intake- and discharge-side priming fluid chambers are allowed to communicate with each other by means of the communication hole means, and a closed position where the communication between the priming fluid chambers is cut off, the valve member being urged toward the open position and adapted to be moved, against the urging action, to the closed position to be held therein by the action of a pump fluid when the fluid flows in a feeding direction, and to be held in the open position when the fluid flows backward.

According to the arrangement of the invention described above, the communication hole means is open only when the pump fluid flows backward, and the valve member is moved to the closed position by the force of flow of the fluid, thereby closing the communication hole means, during the normal pumping operation or self-priming operation. Thus, the aforementioned conventional problems attributed to the pressure leakage through the communication hole means during the pumping operation can be settled.

If a backflow of the fluid is caused when the pump is stopped, the two priming fluid chambers are allowed to communicate with each other on the level of the communication hole means, so that the siphonage is canceled. Thus, the priming fluid can be secured satisfactorily.

According to a preferred specific arrangement of the present invention, the valve assembly is removably attached to the pump casing, so that its replacement, maintenance and inspection are easy.

According to another specific arrangement, the backup member is disposed on the opposite side of the valve member to the partition member, and the valve member engages the backup member when it is in the open position. In this engaged state, a wedge-shaped gap is defined between the valve member and backup member, allowing entrance of the fluid which flows in the feeding direction.

During pumping operation or self-priming operation, with this arrangement, the pump fluid enters the wedge-shaped gap, thereby positively acting on the valve member to move it securely to the closed position. As the fluid passes through a narrow passage which is formed between the valve member and backup member by forcing them apart, the force of the fluid continually acts on the valve member to keep it positively in the closed position.

According to a further specific arrangement, the pump casing includes inner and outer casing members which are coaxial with each other with respect to a vertical axis. The intake- and discharge-side priming fluid chambers are segementally arranged in an annular space between the two casing members. Thus, the pump casing is compact, permitting a reduction in size of the pump as a whole.

The miniaturization of the pump can be further facilitated by designing the pump casing with the aforesaid arrangement so that a rotating body and a magnet housing for magnetically coupling a drive motor and an impeller are contained in the inside space of the inner casing member.

BRIEF DESCRIPTION OF THE DRAWINGS

These and other objects of the present invention will become more apparent and will be better understood with reference to the following detailed description taken in conjunction with the accompanying drawings, in which.

DETAILED DESCRIPTION OF THE PREFERRED EMBODIMENTS

According to an embodiment of the present invention, a vertical volute pump of a magnetially-coupled type is disclosed as a self-priming pump of the invention.

Figure 1:
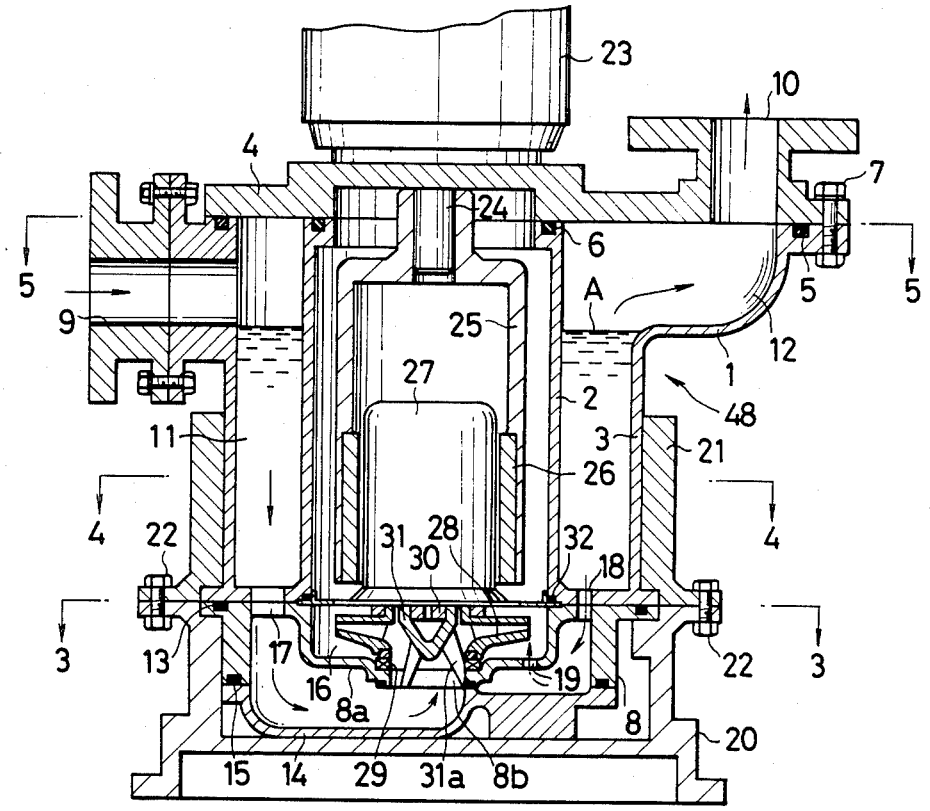
FIG. 1 is a vertical sectional view of a self-priming pump according to an embodiment of the present invention.

Referring now to FIG. 1, an outline of the self-priming pump will be described.

In FIG. 1, numeral 1 denotes a body casing, while numerals 2 and 3 designate an inner casing member and an outer casing member, respectively, of the casing 1. The inner and outer casing members 2 and 3 are coaxial with each other with respect to a vertical axis. A top cover 4 of the casing 1 is mounted on the top opening portion of the inner and outer casing members 2 and 3 by means of bolts 7. Sealing members 5 are interposed between the top cover 4 and the top opening portion. A lower casing 8 is attached to the bottom of the body casing 1. An inlet port 9 and an outlet port 10 are formed at the upper portion of the body casing 1.

An intake-side priming fluid chamber 11 is formed in a part of an annular space between the inner and outer casing members 2 and 3. The chamber 11 communicates with the inlet port 9. A discharge-side priming fluid chamber 12 is segmentally formed in another part of the annular space between the inner and outer casing members 2 and 3. The two priming fluid chambers 11 and 12 are separated from each other by partition members 42 and 43, which will be described in detail later.

The body casing 1 and the lower casing 8 are connected vertically with use of a sealing member 13 between them. Further, a casing bottom cover 14 is coupled to the lower casing 8 by means of a sealing member 15. All these casings and other members constitute a pump casing 48 of the pump of the invention.

The lower casing 8 is formed with a pump chamber 16 defined in its inner casing portion 8*a* and an incoming opening 8*b* in its central portion communicating with the intake-side priming fluid chamber 11. Further, communication holes 17 and 18 are bored through coupling portions of the casings 1 and 8. A circulating hole 19 is formed at the inner casing portion 8*a*, opening into the pump chamber 16. The circulating hole 19, in conjunction with the communication hole 18, creates a circulating flow as indicated by chain-line arrows, thus permitting self-priming operation of the pump for starting.

Lower and upper support frames 20 and 21, which are coupled by means of bolts 22, support the casings 1 and 8, respectively, from the outside. A drive motor 23 is mounted on the body casing 1, having its shaft 24 hanging down in the casing 1. A magnet housing 25 is disposed in the inner casing member 2 and fixed, at its upper end portion, to the motor shaft 24. A driving magnet 26 is attached to the inner periphery of the lower end portion of the magnet housing 25. Numeral 27 designates a seal casing which includes a cylindrical portion closed at the top and a flange portion 27*b*. The cylindrical portion is disposed inside the magnet housing 25. An impeller 28 is disposed in the pump chamber 16 and rotatably supported by the inner casing portion 8*a* in the casing 8 with the aid of a liner ring 29. Numeral 30 designates a spindle. A support member 31, having support legs 31*a*, supports the lower end portion of the spindle 30. A sealing ring 32 is used to seal the seal casing 27 between the inner casing member 2 and inner casing portion 8*a* of the casings 1 and 8 in a liquid-tight manner. The seal casing 27 serves to seal the pump chamber 16 in a liquid-tight manner against a drive mechanism section including the magnet housing 25 and the drive motor 23.

In FIG. 1, a level A of a fluid contained in the intake- and discharge-side priming fluid chambers 11 and 12 corresponds to a predetermined level of priming fluid to be maintained.

Figure 2:
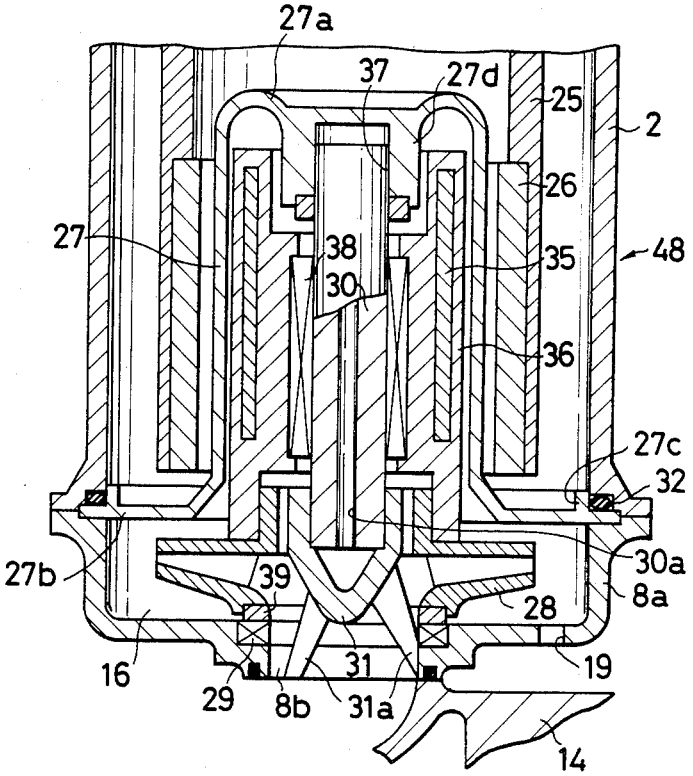
FIG. 2 is an enlarged, vertical sectional view showing a magnetic drive mechanism section of the self-priming pump of FIG. 1.

Referring now to FIG. 2, there are shown components which are surrounded by the seal casing 27. These components include a driven magent 35 facing the driving magnet 26 and a rotating body 36 fixedly fitted, at its lower end portion, on the impeller 28. The driven magnet 35 is embedded in the rotating body 36 by insert molding.

The spindle 30 is in the form of a shaft with a through hole 30*a* extending along its central axis. The upper end portion of the spindle 30 is fitted and supported in a support hollow 37 defined in a support portion 27*d* which protrudes integrally from the inside of a closed top portion 27*a* of the seal casing 27. The rotating body 36 is rotatably supported on the spindle 30 by means of a bearing 38. The impeller 28, along with the rotating body 36, rotates over the liner ring 29 through the medium of a sliding ring 39.

The peripheral edge of the flange portion 27*b*, which is formed integrally around the bottom opening portion of seal casing 27, is held in a liquid-tight manner between the inner casing member 2 and the inner casing portion 8*a* of the casing 8 by means of the sealing ring 32. The flange portion 27*b* is formed integrally with a ring-shaped rib 27*c* which engages the inner wall surface of the inner casing member 2 for a better sealing effect.

Thus, by the sealing casing 27, the pump chamber 16 is completely isolated in a liquid-tight manner from the drive mechanism section including the magent housing 25 and the drive motor 23.

Figure 3:
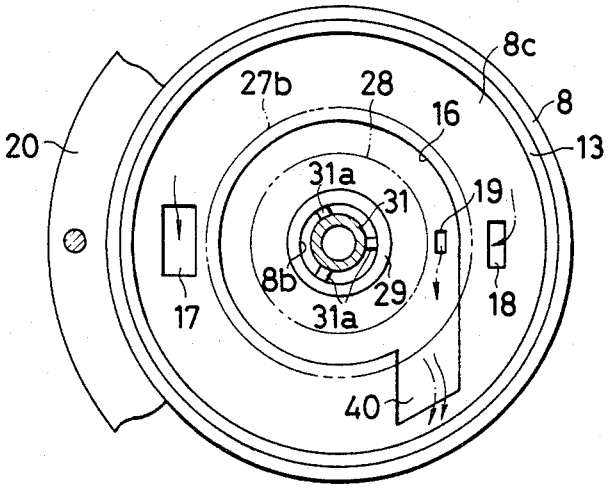
FIG. 3 is a plan sectional view taken along line 3—3 of FIG. 1.
Figure 4:
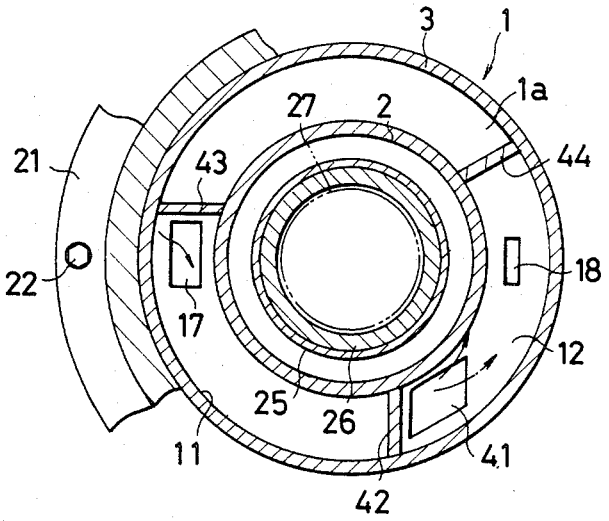
FIG. 4 is a plan sectional view taken along line 4—4 of FIG. 1.

Refering now to FIGS. 3 and 4, there is shown an exit portion 40 of pump chamber 16 which contains therein the impeller 28 as indicated by chain line. The exit portion 40, along with the two communication holes 17 and 18, is formed in a partition wall portion 8*c* which horizontally closes the top face of the lower casing 8. Numeral 41 designates an exit aperture which communicates with the exit portion 40 and opens into the discharge-side priming fluid chamber 12. The exit aperture 41, along with the communication holes 17 and 18, is bored through a partition wall portion 1*a* which horizontally closes the bottom portion of the body casing 1. The intake- and discharge-side priming fluid chambers 11 and 12 are isolatedly divided by the partition members 42 and 43.

Numeral 44 designates a rib for reinforcing the inner and outer casing members 2 and 3.

As seen from FIG. 3, the support legs 31*a* of the support member 31 are three in number and arranged at regular angular intervals of 120 degrees, thus supporting the lower end portion of the spindle 30 in a well-balanced manner.

Among the aforementioned members of the pump, the main components, including the casings 1 and 8, casing bottom cover 14, seal casing 27, and impeller 28, are formed of synthetic resin.

In starting the pump, in the pump arrangement described above, the priming fluid is first fed into the pump casing 48, as shown in FIG. 1, and the drive motor 23 is actuated. As a result, the impeller 28 is rotated through the medium of the rotating body 36 by the effect of uncontacted magnetic coupling between the driving and driven magnets 26 and 35.

Accordingly, the priming fluid is introduced into the pump chamber 16 through the communication hole 18 and the circulating hole 19, as indicated by the chain-line arrows in FIG. 1. Then, the priming fluid is sucked in by the impeller 28, and circulates through the exit portion 40 and the exit aperture 41 into the discharge-side priming fluid chamber 12, as indicated by chain-line arrows in FIGS. 3, 4 and 5. Thus, the so-called self-priming operation is performed. Then, residual air in the chamber 12 is discharged through the outlet port 10, so that the degree of vacuum in the intake-side priming fluid chamber 11 is increased. Ultimately, water or other pump fluid is sucked into the casing and fed in a pump-feeding direction by a negative pressure, as indicated by full-line arrows in FIG. 1, and then discharged through the outlet port 10. Thus, the operation of the pump is started and continued thereafter.

Figure 5:
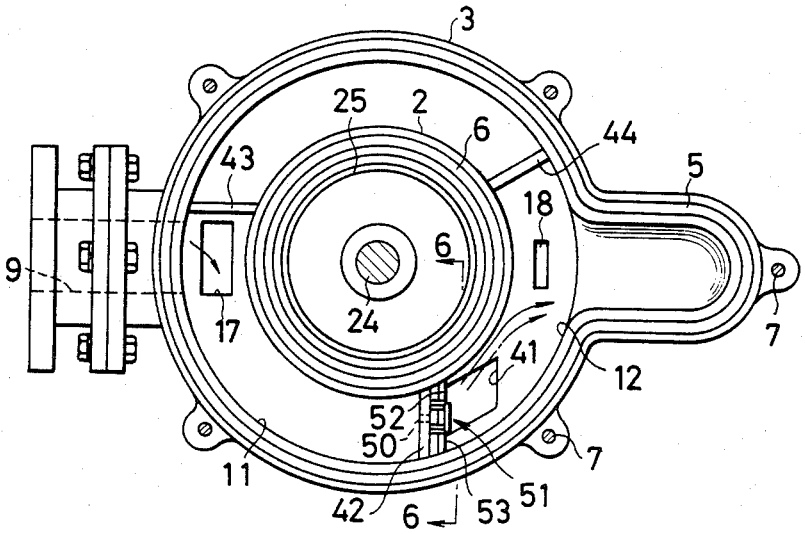
FIG. 5 is a plan sectional view taken along line 5—5 of FIG. 1.
Figure 6:
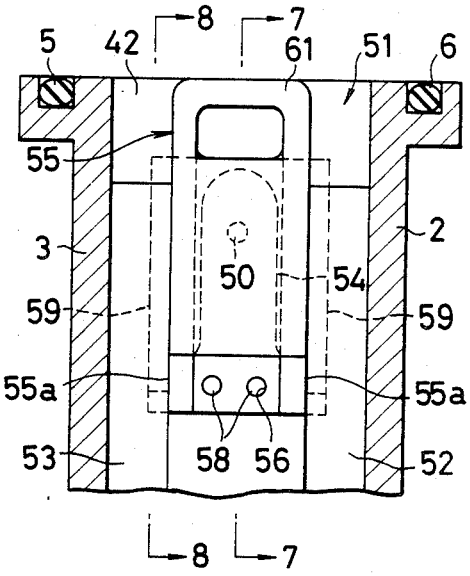
FIG. 6 is an enlarged view taken along line 6—6 of FIG. 5 showing a valve assembly.

Also in FIGS. 3 to 5, the flow of the fluid in the pump-feeding direction is indicated by full-line arrows.

When the pump is stopped, the drive motor 23 and hence the impeller 28 stop, so that the fluid ceases to flow in the feeding direction. Then, the fluid is urged to move to the intake side by a difference in pressure between the intake and discharge sides, thus producing a backflow. In other words, a backflow is caused by siphonage on the intake side, urging the priming fluid to flow out of the pump casing 48.

As shown in FIG. 5, the one partition member 42 dividing the two priming fluid chambers 11 and 12 is formed with a communication hole or orifice 50 by means of which the chambers 11 and 12 communicate with each other. A valve assembly 51 is provided corresponding to the communication hole 50 for cooperation therewith. Thus, the fluid is stopped from flowing out on a predetermined level to secure the priming fluid in the pump casing 48 when the fluid flows backward. In the pumping operation or self-priming operation, the valve assembly 51 prevents an undesired leakage of pressure through the communication hole 50.

The communication hole 50, which is not shown in FIG. 1 due to its position relative to the sectional plane, is located at a height corresponding to the surface level A of the priming fluid shown in FIG. 1.

When the top cover 4 is removed from the body casing 1, the valve assembly 51, which is located close to the top opening portion of the casing 1, is easily accessible through the top opening portion. In this position, the valve assembly 51 is removably attached to a pair of guide members 52 and 53 which protrude from the respective wall surfaces of the inner and outer casing members 2 and 3 toward each other, extending parallel to the partition member 42. In this embodiment, the valve assembly 51 is located within the discharge-side priming fluid chamber 12.

Referring to FIGS. 6 to 9, the valve assembly 51 comprises a flap valve 54 as a valve member formed of rubber or other elastic material, and a valve support member 55 for supporting the valve 54. A pair of mounting holes 56 are bored through the lower end portion of the flap valve 54, while a pair of shafts 58 protrude integrally from a mounting surface 57 at the lower end portion of the valve support member 55. Thus, the flap valve 54 is removably attached to the support member 55 by engaging the mounting holes 56 of the former with the shafts 58 of the latter. A ring-shaped closing portion 54*a* protrudes integrally from that side of the upper portion of the flap valve 54 facing the communication hole 50. When the valve is closed, the closing portion 54*a* is intimately in contact with the wall surface of the partition member 42, surrounding the communication hole 50.

The width of the valve support member 55 is just equal to the distance between the guide members 52 and 53 projecting toward each other. Thus, two opposite side faces 55*a* of the support member 55 slidably engage the respective end edges of the facing guide members 52 and 53. A mounting portion 59 protrudes integrally from each side face 55*a*, projecting sideways. A retaining step portion 59*a* is formed on the upper end portion of the mounting portion 59, bent at right angles. A rounded mounting end portion 59*b* is formed on the lower end of the mounting portion 59. The mounting portion 59 has a thickness such that it can be downwardly slid into a narrow gap 60 (FIG. 8) between the partition member 42 and the guide member 52 or 53.

A grip 61 for the ease of handling the valve assembly 51 is formed on the upper end portion of the valve support member 55. A backup member 62 is formed in the central portion of the support member 55, located on the opposite side of the flap valve 54 to the partition member 42. A slanting surface 63 is formed on that side of the backup member 62 facing the flap valve 54.

Figure 7:
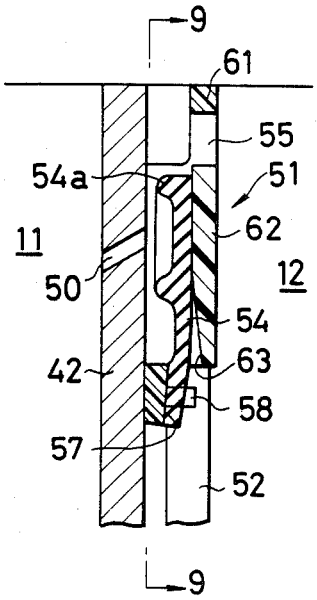
FIG. 7 is a sectional view taken along line 7—7 of FIG. 6.
Figure 8:
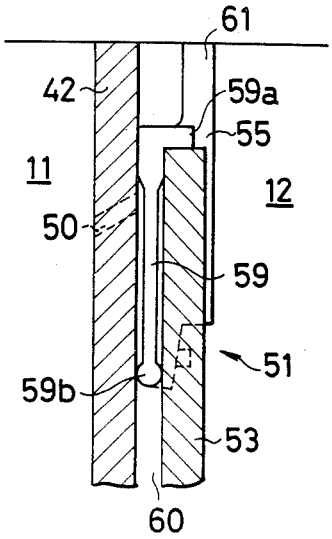
FIG. 8 is a sectional view taken along line 8—8 of FIG. 6.
Figure 9:
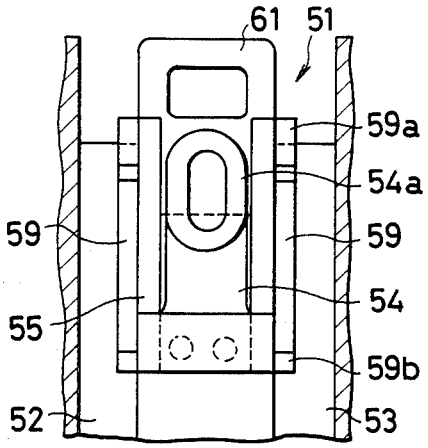
FIG. 9 is a schematic view taken along line 9—9 of FIG. 7.

When mounted on the valve support member 55 as shown in FIG. 7, the flap valve 54 is continually urged in a direction (opening direction) to go away from the communication hole 50 by the slanting mounting surface 57 which constitutes urging means. Thus, the flap valve 54 is always kept in a position (open position) where it elastically abuts against the backup member 62. In this state, therefore, the priming fluid chambers 11 and 12 communicate with each other by means of the communication hole 50.

The valve assembly 51 can be easily removed from the mounting position in the pump casing 48 by pulling up the grip 61. Also, the flap valve 54 can be easily detached from the valve support member 55 by disengaging it from the shafts 58.

Thus, it is very easy to perform replacement, attachment, maintenance, and inspection of the valve assembly.

Figure 10:
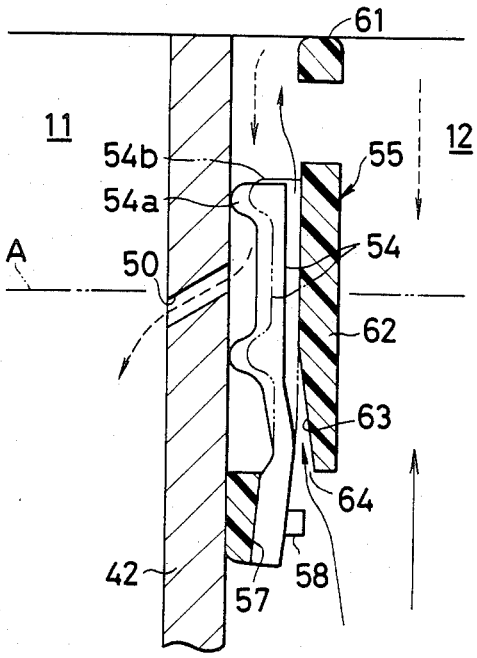
FIG. 10 is a schematic view for illustrating the operation of a valve member of the valve assembly.

Referring now to FIG. 10, the mode of action of the valve assembly 51 relative to the communication hole 50 will be described.

In FIG. 10, full-line arrows indicate the direction of the flow of the pump fluid during the normal pumping operation or self-priming operation, that is, the pump-feeding direction, while broken-line arrows indicate the direction of the backflow produced when the pump is stopped.

When the fluid flows in the feeding direction, part of the fluid fed from below flows into a wedge-shaped gap 64 between the flap valve 54 in the open position, indicated by chain line in FIG. 10, and a slanting surface 63 of the backup member 62 at the back of the valve 54. The gap 64 constitute guide means. Urged by the fluid flow, the flap valve 54 is positively pressed against its own elastic force to a closed position indicated by full line. When the flap valve 54 is in the closed position, a narrow passage is formed between the valve 54 and the backup member 62, and the fluid continually flows through the passage. Accordingly, the flap valve 54 is securely held in the closed position by the pressure of the fluid.

Thus, during the pumping operation or self-priming operation, the communication hole 50 is closed, so that the pressure and fluid are prevented from leaking through the hole 50 between the intake- and discharge-side priming fluid chambers 11 and 12.

While the fluid is flowing backward, the flow of the fluid from above does not act so as to press the flap valve 54 toward the closed position. Therefore, the flap valve 54 is kept open by its elastic force.

Thus, when the fluid filling the pump casing 48 is urged to flow out of the casing by a backflow produced by siphonage after the end of the pumping operation, the fluid surface level lowers. When the level reaches the location of the communication hole 50, the pressure and fluid get through the hole 50 to equilibrate the internal pressure of the two priming fluid chambers 11 and 12. As a result, the siphonage is canceled to keep the priming fluid level on the level A corresponding to the communication hole 50.

Figure 11:
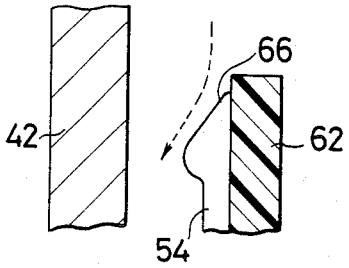
FIG. 11 is a partial enlarged sectional view showing a modified form of the valve assembly.

In this embodiment, an upper end portion **54*b* of the flap valve 54 is level. With this arrangement, the open position can satisfactorily be maintained when the fluid flows backward. If the top end of the valve 54 is formed with a slanting surface 66, as in a modified form shown in FIG. 11, the valve 54 is subjected to a component force to be pressed toward the backup member 62 by the action of the fluid in the backflow. Thus, the flap valve 54** can positively be held in the closed position.

Figure 12:
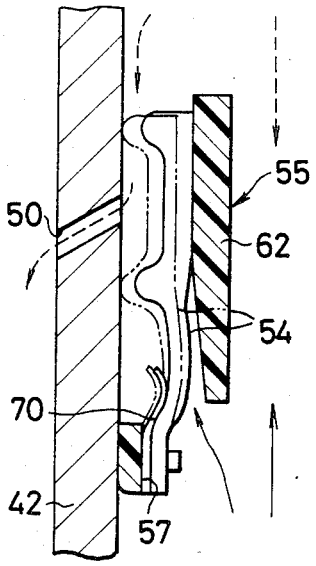
FIG. 12 is a schematic view for illustrating the operation of another modified form of the valve assembly.

In another modified form shown in FIG. 12, a leaf spring 70 is provided as urging means on the mounting surface 57 for the flap valve 54 on the valve support member 55, instead of slanting the surface 57 as shown in FIG. 10.

The leaf spring 70 always urges the flap valve 54 toward the open position. When the fluid flows in the feeding direction, the spring 70 is elastically deformed together with the flap valve 54, thus allowing the valve 54 to move to the closed position.

In the embodiment described above, the flap valve 54 is an integral rubber member of the easiest shape to manufacture. However, only the closing portion **54*a*** may be formed from a rigid material.

In the above embodiment, moreover, the valve assembly 51 is removably attached to the pump casing 48. Alternatively, however, the former may be fixed to the latter without departing from the scope or spirit of the present invention. Instead of being a through orifice, furthermore, the communication hole 50 may be formed by passing a pipe through the partition member 42.

Further, the self-priming pump of the invention is not limited to the magnetically-coupled type, and may also be of a direct-coupled type and other type.

The spirit and scope of the invention should not be limited to any obvious changes or modifications which would occur to those skilled in the art.

What is claimed is:

1. A self-priming pump comprising:

a pump casing;

an inlet port and an outlet port in the pump casing for a pump fluid;

an intake-side priming fluid chamber formed in the pump casing and communicating with the inlet port;

a discharge-side priming fluid chamber formed in the pump casing and communicating with the outlet port;

a pump chamber defined in the pump casing;

an impeller rotatably disposed in the pump chamber;

drive means for rotating the impeller, whereby the fluid is sucked in through the inlet port, circulated in a feeding direction, and discharged through the outlet port;

a partition member for dividing the intake-side priming fluid chamber from the discharge-side priming fluid chamber;

communication hole means bored through the partition member on a predetermined level, whereby the intake-side priming fluid chamber is connected to the discharge-side priming fluid chamber, said communication hole means serving to prevent, on the level thereof, a backflow of the fluid due to siphonage caused when a pumping operation is stopped, thereby keeping the surface level of a priming fluid in the intake- and discharge-side priming fluid chambers on the predetermined level;

a valve assembly provided corresponding to the communication hole means; and a valve member provided in the valve assembly and movable between an open position where the intake- and discharge-side priming fluid chambers are allowed to communicate with each other by means of the communication hole means, and a closed position where the communication between the priming fluid chambers is cut off, said valve member being urged toward the open position, said valve member being adapted to be moved, against the urging action, to the closed position to be held therein by the action of the pump fluid when subjected to a flow of the fluid in the feeding direction, and to be held in the open position when subjected to the backflow of the fluid.

2. The self-priming pump according to claim 1, wherein said valve assembly is disposed in the discharge-side priming fluid chamber.

3. The self-priming pump according to claim 2, wherein said valve member includes a flap vlave formed of an elastic material, and said valve assembly includes a valve support member supporting the flap valve at one end portion thereof.

4. The self-priming pump according to claim 3, wherein a mounting surface of said valve support member supporting the flap valve thereon is inclined at an angle to the side face of the partition member, whereby the flap valve is urged toward the open position.

5. The self-priming pump according to claim 4, wherein said flap valve is removably attached to the valve support member.

6. The self-priming pump according to claim 3, wherein said valve assembly is removable from a mounting position where the valve assembly is mounted in the pump casing.

7. The self-priming pump according to claim 6, wherein said valve support member is provided with a grip for the ease of handling the valve assembly.

8. The self-priming pump according to claim 7, wherein said pump casing is provided with a pair of guide members extending parallel to the partition member with a fixed gap between the partition member and the guide members, and said valve support member integrally includes a retaining step portion engaging the guide members when the valve support member is in the mounting position, and a mounting end portion adapted to be slidably inserted into the gap between the partition member and the guide members from above.

9. The self-priming pump according to claim 1, wherein a backup member is disposed on the opposite side of the valve member to the partition member and engaging the valve member in the open position, and a wedge-shaped gap is defined between the valve member and the backup member when the valve member engages the backup member, said gap permitting penetration of the pump fluid flowing in the feeding direction.

10. The self-priming pump according to claim 9, wherein said valve assembly includes a valve support member supporting the valve member, said backup member being formed integrally on the valve support member.

11. The self-priming pump according to claim 1, wherein said pump casing includes a body casing having an inner casing member and an outer casing member coaxial with each other with respect to a vertical axis, and said intake- and discharge-side priming fluid chambers are arranged segmentally in an annular space between the inner and outer casing members.

12. The self-priming pump according to claim 11, wherein said drive means includes a drive motor mounted on the top portion of the pump casing, a magnet housing coupled to the motor and having a driving magnet, said magnet housing being disposed in the inner casing member so as to be rotatable around the vertical axis, and a rotating body coupled to the impeller and having a driven magnet facing the driving magnet of the magnet housing across a cup-shaped seal casing having a portion projecting into the inner casing member and sealing the pump chamber in a liquid-tight manner against the magnet housing.

* * * * *